United States Patent [19]

Matsumoto

[11] Patent Number: 5,041,877

[45] Date of Patent: Aug. 20, 1991

[54] IMAGE FORMING APPARATUS

[75] Inventor: Kenichi Matsumoto, Tokyo, Japan

[73] Assignee: Canon Kabushiki Kaisha, Tokyo, Japan

[21] Appl. No.: 458,368

[22] Filed: Dec. 28, 1989

[30] Foreign Application Priority Data

Dec. 28, 1988 [JP] Japan ..... 63-334254

[51] Int. Cl.[5] ..... G03G 15/16

[52] U.S. Cl. ..... 355/271; 355/326

[58] Field of Search ..... 355/271, 272, 274, 276, 355/208, 216, 326, 327

[56] References Cited

U.S. PATENT DOCUMENTS 4,772,918 9/1988 Karasawa et al. ..... 355/274
4,791,452 12/1988 Kasai et al. ..... 355/326
4,831,415 5/1989 Kasuya ..... 355/208
4,870,460 9/1989 Harada et al. ..... 355/327 X

FOREIGN PATENT DOCUMENTS 99675 10/1982 Japan .
57364 8/1985 Japan .
63-228179 9/1988 Japan ..... 355/274

*Primary Examiner*—R. L. Moses
*Attorney, Agent, or Firm*—Fitzpatrick, Cella, Harper & Scinto

[57] ABSTRACT

An image forming apparatus of the type having a transfer device for transferring images formed on an image carrying member to a transfer material such as a paper sheet. The apparatus comprises an image carrying member; a charging device for charging the image carrying member; a measuring device for measuring the surface potential of the image carrying member; and a transfer device for forming a transfer electric field by means of which images formed on the image carrying member are transferred to a transfer material. The measuring device measures the surface potential of the image carrying member when it is charged but is not undergoing image transfer and measures the surface potential of the image carrying member when it is charged and is undergoing image transfer. The transfer electric field formed by the transfer device is controlled on the basis of the measurement results thus obtained by the measuring device.

60 Claims, 3 Drawing Sheets

IMAGE FORMING APPARATUS

BACKGROUND OF THE INVENTION

1. Field of the Invention

This invention relates to an image forming apparatus having a transfer means for transferring images formed on an image carrying member to a transfer material (such as a paper sheet).

More specifically, this invention relates to a color-image forming apparatus of the type in which several image components of different colors are successively transferred to the same transfer material (such as a paper sheet), one superimposed on the other.

2. Description of the Related Art

Various types of so-called color-image forming apparatuses have been proposed which are equipped with a plurality of image forming sections where toner images of different colors are formed and transferred to the same transfer material, one superimposed on the other. Of these, most commonly used are color copying machines adopting the multi-color electrophotographic system.

FIG. 5 is a partial sectional view of a conventional color copying machine, which will be briefly described below.

The conventional color copying machine shown includes four image forming sections Pa, Pb, Pc and Pd, which are arranged side by side in the apparatus body. These image forming sections Pa, Pb, Pc and Pd are equipped with respective dedicated image carrying members, which, in this example, consist of electrophotographic photosensitive drums 101*a*, 101*b*, 101*c* and 101*d*.

Respectively provided around the photosensitive drums 101*a*, 101*b*, 101*c* and 101*d* are latent image forming sections 102*a*, 102*b*, 102*c* and 102*d*, developing sections 103*a*, 103*b*, 103*c* and 103*d*, transfer-discharge sections 104*a*, 104*b*, 104*c* and 104*d*, and cleaning sections 105*a*, 105*b*, 105*c* and 105*d*.

With this construction, a latent image consisting of the yellow color component of the original is first formed by the latent-image forming section 2*a* on the photosensitive drum 1*a* of the first image forming section Pa. The latent image is made visible by means of a developer which contains yellow toner and which is provided in the developing section 103*a*. This yellow-toner image is transferred to a transfer material 6 by the transfer-discharge section 104*a*.

While the yellow image is thus being transferred to the transfer material, a latent image consisting of the magenta color component of the original is formed by latent-image forming section 102*b* on photosensitive drum 101*b* by the second image forming section Pb, which is followed by the formation of a magenta-toner image by means of a magenta toner provided in the developing section 103*b*. When the image transfer in the first image forming section Pa has been completed, the transfer material 6 is fed to the transfer-discharge section 104*b*. The magenta-toner image is then transferred to a predetermined position on the transfer material 6.

In the same manner, a cyan and a black image are formed in the third and fourth image forming sections Pc and Pd, and the cyan and black color components of the original are transferred to a predetermined position on the same transfer material. When these image forming processes have been completed, the images on the transfer material are fixed thereon in a fixing section 107, thereby yielding a multi-color image. After the completion of the image-transfer operation, residual toner is removed from the photosensitive drums 101*a*, 101*b*, 101*c* and 101*d* by means of the cleaning sections 105*a*, 105*b*, 105*c* and 105*d*, respectively, thus getting the drums ready for the next latent-image formation.

In this image forming apparatus, which has the above-described construction, the transfer material 6 is fed from the right to the left (as seen in FIG. 5) by means of a feeding belt 108, successively passing the respective transfer sections 104*a*, 104*b*, 104*c* and 104*d* of the image forming sections Pa, Pb, Pc and Pd.

The material of a feeding belt used in an image forming apparatus such as a color electrophotographic copying machine having a construction as described above is generally determined from the viewpoint of the ease with which it can be formed into a belt, its durability, and so on. Thus, the following two types of material have been proposed:

(1) Polyester-fibers worked into meshes forming a belt; and (2) A thin sheet of a dielectric material such as polyethylene-terephthalate-type resin, polyimide-type resin, or urethane-type resin, which is worked into a belt like the above material (1).

However, the inventor of the present invention has found out through experiment that the material (1) is likely to involve inter-fiber dislocation since it is woven into meshes, so that the belt itself can be deformed, which results in the transmission efficiency of the belt-feeding-speed control being deteriorated. Accordingly, the correct feeding speed cannot be maintained, distorting the images formed on transfer material 6. In addition, this mesh structure does not allow the transfer material to be kept in sufficiently close contact with the feeding belt, so that uneven image transfer is likely to occur due to the vibration o: the belt and the surface irregularities thereof.

Furthermore, it is to be noted that the size of each mesh is far larger than the diameter of the toner particles. As a result, the toner on the photosensitive drum passes through the meshes of the belt except for the portion thereof which is transferred to the transfer material on the drum, and is scattered over the components on the transfer-electrode side, such as the transfer-chargers, resulting in the transfer electrodes being contaminated with toner.

In view of this, the material of type (2) is preferred. It exhibits a high tensile elasticity, and provides a satisfactory transmission efficiency in belt-drive control. Further, its volume resistivity is generally as high as $10^{16}\Omega$cm or more, a feature which proves very advantageous for effecting electrostatic adhesion between the belt and the transfer material. As will be appreciated, this material is free from the problems experienced with the material of the above type (1).

However, since it exhibits a high volume resistivity, using this material in a case where image transfer is repeated several times, as in a color electrophotographic apparatus, results in the feeding belt being charged through image transfer, and, as the transfer is repeated, changes occur in the transfer current.

In this regard, Japanese Patent Laid-Open No. 60-57364 discloses a method of measuring the charge amount in a feeding belt. According to this method, which is to be applied to a monochrome copying machine, the surface potential of the feeding belt is measured at positions in front of and behind the transfer charger, thus controlling the transfer charger. With this method, however, the influence of the transfer current on the photosensitive drum cannot be measured, so that the transfer current cannot be controlled accurately.

Apart from this, Japanese Patent Laid-Open No. 57-99675 discloses a method according to which the surface potential of the photosensitive member (of a monochrome copying machine) is measured, thereby making it possible to control the transfer-charge amount. This method, however, does not measure the change in the surface potential in front of and behind the transfer means, which means the transfer-charge amount cannot be accurately controlled by this method.

SUMMARY OF THE INVENTION

It is accordingly an object of this invention to provide an image forming apparatus in which the surface potential of the image carrying member in front of and behind the transfer means is measured, thereby permitting the transfer electric field to be set to an appropriate value.

Another object of this invention is to provide an image forming apparatus in which the surface potential of the image carrying member before the image formation is detected, thereby permitting the transfer electric field to be set to an appropriate value.

Still another object of this invention is to provide an image forming apparatus which uses toners of different colors and in which the surface potential of the image carrying member is detected, thereby permitting the transfer electric field to be set to an appropriate value.

A further object of this invention is to provide an image forming apparatus in which the surface potential of the image carrying member when forming an image is measured, thereby permitting the transfer electric field to be set to an appropriate value.

In accordance with this invention, there is provided an image forming apparatus, comprising a movable image carrying member, charging means for charging the image carrying member, measuring means for measuring the surface potential of the image carrying member, and transfer means for transferring images from the image carrying member to a transfer material; wherein the measuring means measures the surface potential of the image carrying member when it is charged by the charging means but is not undergoing image transfer, and measures the surface potential of the image carrying member when it is charged by the charging means and is undergoing image transfer, the transfer means being controlled on the basis of the measurement result obtained by the measuring means.

Other objects of this invention will become apparent from the following description of the preferred embodiments.

DESCRIPTION OF THE PREFERRED EMBODIMENTS

Embodiments of this invention will now be described with reference to the accompanying drawings.

Figure 1:
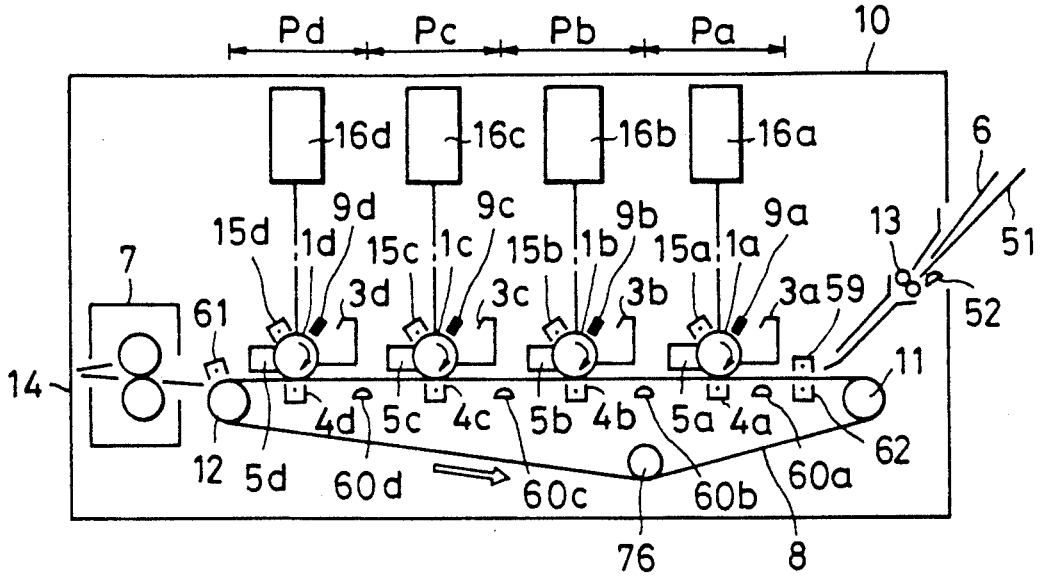
FIG. 1 is a sectional view of an image forming apparatus in accordance with a first embodiment of this invention.

FIG. 1 shows an image forming apparatus in accordance with the first embodiment of this invention. The apparatus shown includes an apparatus body 10 in which are arranged image forming sections Pa, Pb, Pc and Pd, which will be described below. Provided below the image forming sections are a transfer-material feeding means consisting of a drive rollers 11, 12 and 76, and a feeding belt 8 stretched around these rollers. The feeding belt 8 is moved in the direction indicated by the arrow.

Arranged on the right-hand side (as seen in FIG. 1) of the feeding belt 8 is a paper feeding mechanism 13, through which a transfer material 6 (e.g., a paper sheet) is conveyed onto the feeding belt 8. When image transfer to the transfer material 6 has been completed in the image forming sections Pa, Pb, Pc and Pd, the transfer material 6 is conveyed to a fixing device 7 which is provided on the left-hand side of the feeding belt 8. The transfer material 6, upon which toner-image components have been fixed, is then discharged to the exterior of the apparatus through a discharge outlet 14.

The first, second, third and fourth image forming sections Pa, Pb, Pc and Pd, arranged side by side above the feeding belt 8, are equipped with photosensitive drums 1*a*, 1*b*, 1*c* and 1*d*, respectively. These photosensitive drums are respectively provided with chargers 15*a*, 15*b*, 15*c* and 15*d* arranged at the upper left of the associated photosensitive drum, surface potential sensors 9*a*, 9*b*, 9*c* and 9*d* arranged at the upper right of the associated photosensitive drum, developing devices 3*a*, 3*b*, 3*c* and 3*d* arranged at the right of the associated photosensitive drum, transfer chargers 4*a*, 4*b*, 4*c* and 4*d* arranged below the associated photosensitive drum, and cleaning sections 5*a*, 5*b*, 5*c* and 5*d* arranged to the left of the associated photosensitive drum.

Laser beam scanners 16*a*, 16*b*, 16*c* and 16*d* are arranged above the photosensitive drums 1*a*, 1*b*, 1*c* and 1*d*, respectively. These laser beam scanners may consist of semiconductor lasers, polygon mirrors, f$\theta$-lenses or the like. Upon receiving electrical digital image signals, these laser beam scanners conduct scanning with laser beams modulated in accordance with these signals. The scanning is conducted over the drum-surface sections between the chargers 15*a*, 15*b*, 15*c*, 15*d* and developing devices 3*a*, 3*b*, 3*c*, 3*d*, in the direction of the generating line of the photosensitive drums 1*a*, 1*b*, 1*c* and 1*d*, thus effecting the exposure of these drums.

In more detail, a pixel signal corresponding to the yellow color component of the color image to be obtained is delivered to the laser scanner 16*a* of the first image forming section Pa, and a pixel signal corresponding to the magenta color component of the same image is input to the laser scanner 16*b* of the second image forming section Pb. Respectively delivered to the laser scanners 16*c* and 16*d* of the third and fourth image forming sections Pc and Pd are pixel signals corresponding to the cyan and black color components of the color image, respectively.

The above-mentioned paper feeding mechanism 13 is equipped with a paper feeding guide 51 and a sensor 52. When the transfer material 6 is inserted into the paper feeding guide 51, the sensor 52 detects the leading edge thereof, and transmits a rotation-start signal to the drive devices (not shown) of the photosensitive drums 1*a*, 1*b*, 1*c* and 1*d*. At the same time, the sensor 52 causes the drive rollers 11, 12 and 76 to operate, thereby causing the feeding belt 8 to move. The transfer material 6, fed onto the feeding belt 8, is subjected to corona charging from adhesion chargers 59 and 62, which causes it to reliably adhere securely to the surface of the feeding belt 8. In this embodiment, the respective high-voltage polarities of the adhesion chargers 59 and 62 are reverse to each other, the charger 62 exhibiting the same polarity as transfer chargers 4*a*, 4*b*, 4*c* and 4*d*.

This embodiment adopts the reversal-development method. Thus, the photosensitive drums 1*a*, 1*b*, 1*c* and 1*d* are negatively charged by the chargers 15*a*, 15*b*, 15*c* and 15*d* and, after being exposed by means of laser beams, are developed with negatively charged toner. Accordingly, the polarity of the transfer chargers 4*a*, 4*b*, 4*c* and 4*d* is positive.

The image forming sections Pa, Pb, Pc and Pd are further equipped with sensors 60*a*, 60*b*, 60*c* and 60*d*, respectively. As the leading edge of the transfer material 6 passes these sensors one by one, image formation is successively started on the rotating photosensitive drums 1*a*, 1*b*, 1*c* and 1*d*. When the transfer material 6 has passed the fourth image forming section Pd, a charge remover 61, to which AC voltage is applied, removes the electric charge from the transfer material 6, which is then separated from the feeding belt 8.

Next, the transfer material 6 enters the fixing device 7, where the toner image is fixed upon it. The transfer material 6 is then discharged through the discharge outlet 14. In this fixing device 7, the toner image components of different colors, formed on the transfer material 6, with one being superimposed on the other, are mixed with each other when being fixed on the transfer material 6.

In this invention, it is desirable that the feeding belt 8 be made of a material which is not prone to expand and which allows the rotation control of the drive rollers to be efficiently transmitted to the feeding belt. At the same time, it is desirable that the structure of the feeding belt 8 is such that it does not much affect the transfer corona current in the transfer process.

An example of preferable material for the feeding belt 8 may be polyurethane belts manufactured by Hokushin Kogyo Kabushiki-Kaisha. Of those, the one having a thickness of about 100 μm, a rubber hardness of 97° D., and a tensile elasticity modulus of 16,000 kg/cm$^2$ is particularly preferable.

In order to quantitatively ascertain the transfer condition in the image forming sections, the transfer current flowing from chargers 4*a*, 4*b*, 4*c* and 4*d* to the photosensitive-drum side was measured for each image forming section.

Figure 2:
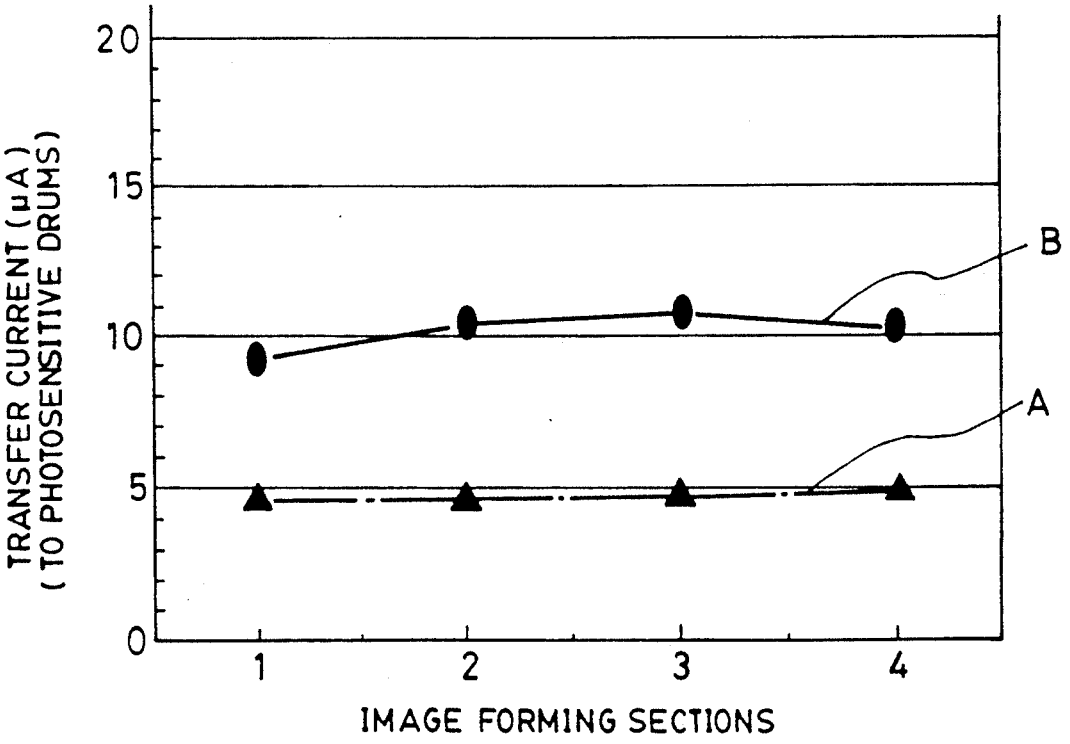
FIG. 2 is a graph showing the values of the transfer current flowing to the side of the photosensitive drums in the image forming sections when the total transfer current is the same for all the image forming sections.

FIG. 2 shows the values of the transfer current flowing to the photosensitive-drum side of the image forming sections.

A feeding belt made of the above-mentioned material was used for the measurement. The reference character A in FIG. 2 indicates the transfer current flowing to the photosensitive-drum side as measured under normal temperature and normal humidity (20° C., 60%RH). The transfer conditions were as follows: the total transfer current was −450 μA in all image forming sections. The distance between the transfer-discharge wires and the photosensitive drum was purposely varied from one image forming section to the other it was 11 mm, 12 mm, 13 mm, and 14 mm in the first, second, third and fourth image forming sections, respectively. The distance between the transfer-discharge wires and the electrode back plates were set at 8.5 mm on both sides.

The conditions for achieving adhesion charging, which is to be effected prior to image transfer, were as follows: both the upper and lower adhesion chargers 59 and 62 had the same configuration as the transfer chargers 4*a*, 4*b*, 4*c* and 4*d*. The total current value was 200 μm in both the upper and lower adhesion chargers (The charging polarity was positive in the upper adhesion charger and negative in the lower). The distance between the discharge wires of the transfer chargers and the feeding belt was set at 11 mm.

As shown by the measurement results in FIG. 2, the transfer current remains substantially constant while the feeding belt 8 successively passes the image forming sections. Any deviation is due to the minor variations in the distances between the transfer-discharge wires and the photosensitive drums.

Next, the behavior of the current in the image forming sections when exposed to high temperatures and high humidity (30° C., 90%RH), which is indicated by the reference character B in FIG. 2, will be described. The other conditions were the same as in the above-described case.

It is to be noted here that these two measurements were conducted when the transfer material 6 was not being fed.

As shown in FIG. 2, the transfer current flowing to the photo-sensitive drum side increases under high temperature and high humidity. The cause of this phenomenon has not yet been fully ascertained. Probably it is attributable to the changes in volume resistivity due to the adhesion of water molecules to the macromolecules forming the feeding belt 8.

It is therefore understood from the above that keeping the voltage applied to the transfer-chargers constant results in the feeding belt being charged when transfer is repeated. It is further understood that the transfer current may undergo changes when the environmental conditions are changed.

In accordance with this embodiment, the transfer current flowing to the photosensitive-drum side is not kept constant but is determined on the basis of the respective surface potentials of the photosensitive drums as measured by surface-potential sensors 9*a*, 9*b*, 9*c* and 9*d*, and the value of the transfer-current depends on the changes in the surface potentials.

In more detail, the photosensitive drums 1*a*, 1*b*, 1*c* and 1*d* are first charged with a voltage of about −630V by chargers 15*a*, 15*b*, 15*c* and 15*d* in such a manner that they exhibit a constant surface potential, and the photosensitive drums continue to rotate past the respective transfer sections, without effecting exposure or development of images.

Because of dark attenuation, the surface potential of the photosensitive drums is reduced to about −600 V immediately before image transfer. In this condition, the transfer material 6 is not being fed, and the transfer current flows directly to the photosensitive-drum side through the feeding belt.

Figure 3:
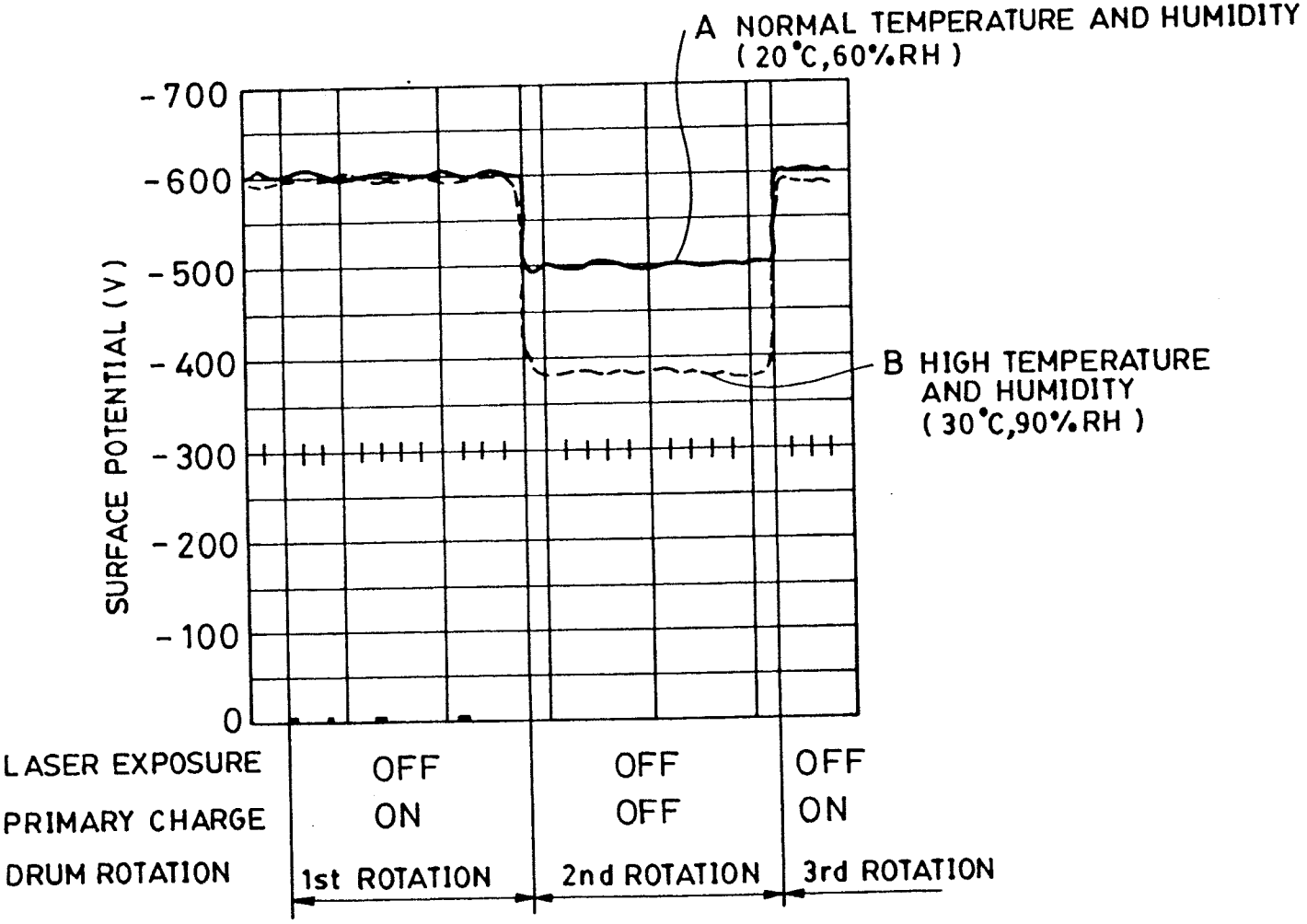
FIG. 3 is a graph showing changes in the surface potential of a photosensitive drum in the apparatus shown in FIG. 1.

The changes in the surface potential are shown by way of example in FIG. 3, which is a graph of measurements of the surface potential in the image forming section Pa. The measurements were conducted using the surface-potential sensor 9*a*. The reference character A indicates the surface potential under normal temperature and normal humidity (20° C., 60%RH), and the reference character B indicates the surface potential under high temperature and high humidity (30° C., 90%RH).

In accordance with this embodiment, the surface-potential values of these photosensitive drums are measured, and the transfer charges are controlled so that the transfer electric fields that they generate are such that the difference in potential before and after transfer is kept constant.

That is, in accordance with this embodiment, the surface-potential sensors measure the surface potential of the photosensitive drums when they are charged by the chargers but are not undergoing image transfer by the transfer devices, and measure the surface potential of the photosensitive drums when they are charged by the chargers and are undergoing image transfer by the transfer devices. On the basis of the results of these measurements, the transfer chargers, and consequently the transfer electric fields are controlled.

By virtue of this arrangement, the invention allows the transfer electric field formed by the transfer chargers to be set to an appropriate value even if environmental conditions have been changed, thereby making it possible to obtain stable, high-quality images on the transfer material.

The method of controlling the transfer electric field is as follows: when the change in the surface potential as measured by the surface potential sensors is greater than a predetermined value, the transfer current is diminished, and, when it is smaller than this predetermined value, the transfer current is augmented.

This also applies to the case where, instead of the transfer current, the voltage to be applied to the transfer devices is controlled.

By conducting this algorithm for each of the four image forming sections, the transfer current flowing to the photosensitive-drum side can be prevented from changing due to environmental changes or the like.

In this embodiment, the above-mentioned control of the transfer current was conducted each time the main switch of the apparatus is turned on, that is, by idling the photosensitive drums during a period while the fixing device 7 is warming up.

Thus, in accordance with this embodiment, the surface potential of the photosensitive drums can be measured more easily and more reliably, so that the transfer current can be controlled more accurately, which allows the image transfer to be performed in a more appropriate manner.

It is more desirable that, after the copying push-button switch has been turned on, the feeding belt be moved before the image formation is started so that the above-described control of the transfer current may be conducted in the same portion of the feeding belt in each of the image forming sections.

This arrangement makes it possible to take into account not only the environmental changes but also changes in the transfer current due to the charging of the feeding belt and so on, which allows an appropriate transfer electric field to be obtained in each image forming section, thereby making it possible to perform image transfer in a satisfactory manner.

Figure 4:
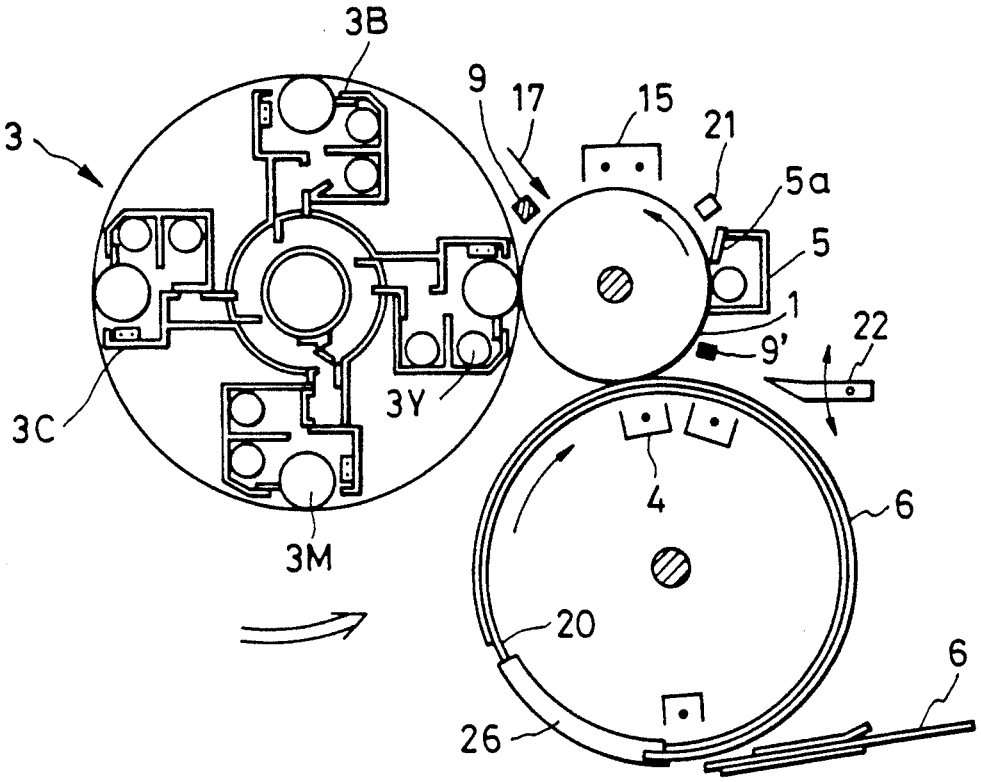
FIG. 4 is a partial sectional view of an image forming apparatus in accordance with a second embodiment of this invention.
Figure 5:
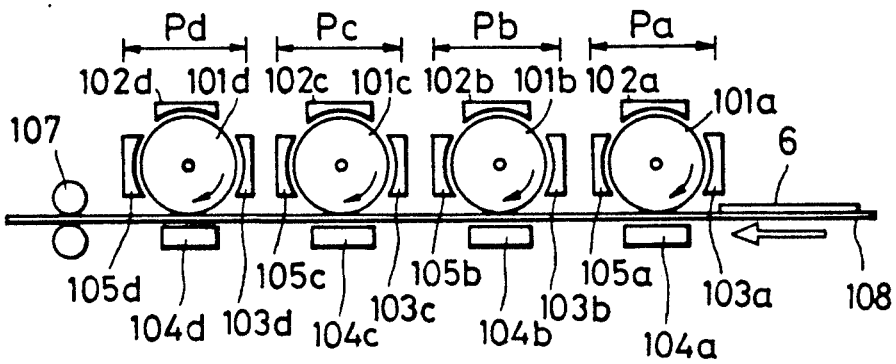
FIG. 5 PRIOR ART
FIG. 5 is a sectional view of a conventional image forming apparatus.

FIG. 4 is a partial sectional view of an image forming apparatus in accordance with the second embodiment of this invention.

The color electrophotographic copying machine of this embodiment includes a photosensitive drum 1, on which different latent images corresponding to different color image components of the original are formed by a pre-exposure means 21, a corona charger 15, an image-exposure means 17, and so on. These latent images are made visible by means of a rotary developing device 3 which comprises a rotating body equipped with a yellow-image developing device 3Y, a magenta-image developing device 3M, a cyan-image developing device 3C, and a black-image developing device 3B. These developing devices contain developer consisting of yellow, magenta, cyan, and black toners, respectively. With this rotary developing device, the rotation of the rotating body is selectively stopped at respective developing positions where the photosensitive drum 1 faces the developing devices for different colors, thereby developing the latent images obtained through color separation.

The toner images are transferred to a transfer material 6 by means of transfer corona chargers 4. The transfer material 6 is retained on a transfer drum 20 by means of a gripper section 26 provided on the surface of the drum. That portion of the toner which has not been used for the image transfer, remaining on the surface of the photosensitive drum 1, is removed by means of a cleaner 5 having a blade 5*a*. After four toner images of different colors have been transferred in registration to the transfer material 6, the transfer material 6 is separated from the transfer drum 20 by means of a cantilevered separating claw 22, and is conveyed to a fixing device (not shown), where the toner images of different colors, formed on the transfer material with one being superimposed upon the other, are mixed with each other to yield a full-color image.

As in the first embodiment, the surface potential of the photosensitive drum 1 is measured in this embodiment by means of a surface-potential sensor 9 with a view to controlling the transfer electric field in such a manner that the change in the surface-potential value of the photosensitive drum before and after image transfer is kept constant.

Thus, like the above-described first embodiment, this embodiment makes it possible to control the transfer charger 4 so that the transfer electric field attains to an appropriate value even when environmental conditions change, or when the transfer devices are contaminated, or when the transfer drum is charged, thus making it possible to effect image transfer in a satisfactory manner.

Next, a third embodiment of this invention will be described. This embodiment has substantially the same construction as the above-described first embodiment, so only the difference between them will be described here.

In the first embodiment described above, the surface potential is measured during the idling before the start of the image formation, thereby controlling the transfer electric field during image formation, whereas, in this embodiment, the surface potential is measured during image formation.

That is, in this embodiment, the surface potential of a photosensitive drum is measured while an image component is being transferred from it to the transfer material. On the basis of the result of this measurement, the transfer charger is controlled when the next image component is transferred to the transfer material and superimposed on the previous one. In this case, the surface-potential sensors are adapted to measure the surface potential of the associated photosensitive drum at those positions of its surface where it is influenced, even during image formation, only by the charging and the image transfer effected by the associated charger and the transfer device, respectively.

Thus, in this embodiment, it is not necessary to effect idling in each image forming section when surface-potential measurement is to be conducted. Accordingly, this embodiment allows image transfer to be performed more speedily and with a more accurate transfer electric field than the first embodiment.

While in the above-described embodiments the surface-potential sensor 9 for forming images is used to measure the surface potential of the photosensitive drum, a similar measurement can be conducted by providing, if possible from the viewpoint of cost and space, a similar surface-potential sensor 9' on the downstream side of the transfer position, as shown in FIG. 4.

It goes without saying that the surface-potential sensor 9 then measures the surface potential of the photosensitive drum when it is charged by the charger but is not undergoing image transfer, whereas the surface potential sensor 9' measures the surface potential of the photosensitive drum when it is charged by the charger and is undergoing image transfer effected by the transfer device. These measurements may then be used in the same manner as in the first embodiment, although it will be evident that an idling sequence is no longer necessary.

This invention should not be construed as restricted to the above-described embodiments. It covers all such modifications as fall within the scope of the invention.

What is claimed is:

1. An image forming apparatus comprising:

a movable image carrying member;

charging means for charging said image carrying member;

measuring means for measuring the surface potential of said image carrying member; and transfer means for transferring images formed on said image carrying member to a transfer material;

wherein said measuring means measures the surface potential of said image carrying member when it is charged by said charging means but is not undergoing image transfer, and measures the surface potential of said image carrying member when it is charged by said charging means and is undergoing image transfer, said transfer means being controlled on the basis of the measurement result obtained by said measuring means.

2. An image forming apparatus as claimed in claim 1, wherein said transfer means includes means for forming a transfer electric field adapted to transfer the images to the transfer material, the transfer electric field being controlled on the basis of the measurement result obtained by said measuring means.

3. An image forming apparatus as claimed in claim 2, wherein said transfer electric field is controlled so that the change in surface-potential value of the image carrying member before and after image transfer is substantially constant.

4. An image forming apparatus as claimed in claim 1, wherein said measuring means comprises a measuring sensor, said measuring sensor being arranged on the upstream side of said transfer means and on the downstream side of said charging means with respect to the moving direction of said image carrying member.

5. An image forming apparatus as claimed in claim 4, wherein said measuring sensor measures the surface potential of said image carrier when it is charged but is not undergoing image transfer as well as the surface potential of the image carrier when it is charged and is undergoing image transfer.

6. An image forming apparatus as claimed in claim 1, wherein said measuring means comprises a first and a second measuring sensor, said first measuring sensor being arranged on the upstream side of said transfer means and on the downstream side of said charging means with respect to the moving direction of image carrier, said second measuring sensor being arranged on the downstream side of said charging means with respect to the moving direction of said image carrier.

7. An image forming apparatus as claimed in claim 6, wherein said first measuring sensor measures the surface potential of said image carrier when it is charged but is not undergoing image transfer, said second measuring sensor measuring the surface potential of said image carrier when it is charged and is undergoing image transfer.

8. An image forming apparatus as claimed in claim 1, wherein said transfer means consists of transfer charges the transfer current of which is controlled on the basis of the measuring result obtained by said measuring means.

9. An image forming apparatus as claimed in claim 1, wherein a voltage applied to said transfer means is controlled on the basis of the measuring result obtained by said measuring means.

10. An image forming apparatus as claimed in claim 1, wherein a transfer electric field is formed by said transfer means and is controlled in such a manner that the change in the surface potential is kept constant on the basis of the measuring result obtained by said measuring means.

11. An image forming apparatus as claimed in claim 10, wherein the transfer electric field is intensified when the change in said surface potential is smaller than a predetermined value.

12. An image forming apparatus as claimed in claim 10, wherein the transfer electric field is attenuated when the change in said surface potential is larger than a predetermined value.

13. An image forming apparatus comprising:

a movable image carrying member;

charging means for charging said image carrying member;

measuring means for measuring the surface potential of said image carrying member; and transfer means for transferring images formed on said image carrying member to a transfer material;

wherein said measuring means measures the surface potential of said image carrying member during a warm-up period before image formation starts; and wherein said transfer means during image formation is controlled on the basis of the measurement result obtained by said measuring means.

14. An image forming apparatus as claimed in claim 13, wherein said transfer means includes means for forming a transfer electric field adapted to transfer the images to the transfer material, the transfer electric field being controlled on the basis of the measurement result obtained by said measuring means.

15. An image forming apparatus as claimed in claim 14, wherein said transfer electric field is controlled so that the change in surface potential value of the image carrying member before and after image transfer is substantially constant.

16. An image forming apparatus as claimed in claim 13, wherein said measuring means measures the surface potential of said image carrying member when it is charged by said charging means but is not undergoing image transfer.

17. An image forming apparatus as claimed in claim 13, further comprising fixing means for fixing toner images upon said transfer material, wherein toner images of different colors are formed upon said transfer material, one superimposed upon the other, by said transfer means, said fixing means mixing the toners of different colors with each other in the process of fixing the images upon said transfer material.

18. An image forming apparatus as claimed in claim 13, further comprising a plurality of image forming sections each of which includes at least said image carrying member, said charging means and said transfer means, images of different colors being formed in said image forming sections by superimposing one image upon the other on said transfer material.

19. An image forming apparatus as claimed in claim 18, wherein the number of said image forming sections is four, in correspondence with the colors: yellow, magenta, cyan and black.

20. An image forming apparatus as claimed in claim 13, further comprising a transfer drum adapted to adsorb said transfer material, images being formed upon said transfer material, with one being superimposed upon the other, by rotating said transfer drum.

21. An image forming apparatus as claimed in claim 13, wherein said transfer means is comprised of transfer chargers the transfer current of which is controlled on the basis of the measuring result obtained by said measuring means.

22. An image forming apparatus comprising:

a movable image carrying member;

charging means for charging said image carrying member;

measuring means for measuring the surface potential of said image carrying member;

a plurality of developing means which are adapted to develop a toner image onto said image carrying member and which respectively contain toners of different colors; and transfer means for transferring the toner images formed on said image carrying member to a transfer material;

wherein said measuring means measures the surface potential of said image carrying member after development by each of said plurality of developing means, and said transfer means is controlled on the basis of the measurement result obtained by said measuring means.

23. An image forming apparatus as claimed in claim 22, wherein said transfer means includes means for forming a transfer electric field adapted to transfer the images to the transfer material, the transfer electric field being controlled on the basis of the measurement result obtained by said measuring means.

24. An image forming apparatus as claimed in claim 23, wherein said transfer electric field is controlled so that the change in surface-potential value of the image carrying member before and after image transfer is substantially constant.

25. An image forming apparatus as claimed in claim 22, wherein said measuring means measures the surface potential of said image carrying member when it is charged by said charging means but is not undergoing image transfer, and measures the surface potential of said image carrier when it is charged by said charging means and is undergoing image transfer.

26. An image forming apparatus as claimed in claim 22, further comprising fixing means for fixing toner images upon said transfer material, wherein toner images of different colors are formed upon said transfer material, one superimposed upon the other, by said transfer means, said fixing means mixing the toners of different colors with each other in the process of fixing the images upon said transfer material.

27. An image forming apparatus as claim in claim 22, wherein said transfer means is comprised of transfer chargers the transfer current of which is controlled on the basis of the measuring result obtained by said measuring means.

28. An image forming apparatus comprising:

a movable image carrying member;

measuring means for measuring the surface potential of said image carrying member;

a plurality of developing means which are adapted to develop a toner image onto said image carrying member and which respectively contain toners of different colors; and transfer means for transferring the toner images formed on said image carrying member to a transfer material;

wherein said transfer means is controlled on the basis of the measurement result obtained by said measuring means; and wherein said measuring means the surface potential of said image carrying member before starting image formation.

29. An image forming apparatus as claim in claim 28, wherein said transfer means includes means for forming a transfer electric field adapted to transfer the images to the transfer material, the transfer electric field being controlled on the basis of the measurement result obtained by said measuring means.

30. An image forming apparatus as claim in claim 28, wherein said measuring means measures the surface potential of said image carrying member when it is charged by said charging means but is not undergoing image transfer, and measures the surface potential of said image carrier when it is charged by said charging means and is undergoing image transfer.

31. An image forming apparatus as claim in claim 28, further comprising fixing means for fixing toner images upon said transfer material, wherein toner images of different colors are formed upon said transfer material, one superimposed upon the other, by said transfer means, said fixing means mixing the toners of different colors with each other in the process of fixing the image upon said transfer material.

32. An image forming apparatus as claim in claim 28, further comprising a plurality of image forming sections each of which includes at least said image carrying member, said charging means, said measuring means, said developing means and said transfer means, image of different colors being formed in said image forming sections by superimposing one image upon the other on said transfer material.

33. An image forming apparatus as claim in claim 32, wherein the number of said image forming sections is four, in correspondence with the colors: Yellow, magenta, cyan and black.

34. An image forming apparatus as claim in claim 28, wherein said transfer means is comprised of transfer chargers the transfer current of which is controlled on the basis of the measuring result obtained by said measuring means.

35. An image forming apparatus comprising a plurality of image forming sections each of which includes at least a movable image carrying member, charging means for charging said image carrying members, measuring means for measuring the surface potential of said image carrying member, developing means which are adapted to develop a toner image onto said image carrying member, and transfer means for transferring the toner images formed on said image carrying member to a transfer material;

wherein different ones of said developing means respectively contain toner of different colors and images of different colors are formed in said image forming sections by superimposing one image upon the other on said transfer material; and wherein said transfer means is controlled on the basis of the measurement result obtained by said measuring means.

36. An image forming apparatus as claimed in claim 35, wherein the number of said image forming sections is four, in correspondence with the colors: yellow, magenta, cyan and black.

37. An image forming apparatus as claimed in claim 35, wherein said transfer means includes means for forming a transfer electric field adapted to transfer the images to the transfer material, the transfer electric field being controlled on the basis of the measurement result obtained by said measuring means.

38. An image forming apparatus as claimed in claim 35, wherein said measuring means measures the surface potential of said image carrying member before starting image information.

39. An image forming apparatus as claimed in claim 35, wherein said measuring means measures the surface potential of said image carrying member when it is charged by said charging means but is not undergoing image transfer, and measures the surface potential of said image carrier when it is charged by said charging means and is undergoing image transfer.

40. An image forming apparatus as claimed in claim 35, further comprising fixing means for fixing toner images upon said transfer material, wherein toner images of different colors are formed upon said transfer material, one superimposed upon the other, by said transfer means, said fixing means mixing the toners of different colors with each other in the process of fixing the image upon said transfer material.

41. An image forming apparatus as claimed in claim 35, wherein the number of said image forming sections is four, in correspondence with the colors: Yellow, magenta, cyan and black.

42. An image forming apparatus as claimed in claim 35, wherein said transfer means is comprised of transfer chargers the transfer current of which is controlled on the basis of the measuring result obtained by said measuring means.

43. An image forming apparatus comprising:

a movable image carrying member;

charging means for charging said image carrying member;

measuring means for measuring the surface potential of said image carrying member;

a plurality of developing means which are adapted to develop a toner image onto said image carrying member and which respectively contain toners of different colors;

transfer means for transferring the toner images formed on said image carrying member to a transfer material; and a transfer drum adapted to absorb said transfer material, images of different colors being formed on said transfer material, with one superimposed upon the other, by rotating said transfer drum;

wherein said transfer means is controlled on the basis of the measurement result obtained by said measuring means.

44. An image forming apparatus as claimed in claim 43, wherein said transfer means includes means for forming a transfer electric field adapted to transfer the images to the transfer material, the transfer electric field being controlled on the basis of the measurement result obtained by said measuring means.

45. An image forming apparatus as claimed in claim 43, wherein said measuring means measures the surface potential of said image carrying member before starting image information.

46. An image forming apparatus as claimed in claim 43, wherein said measuring means measures the surface potential of said image carrying member when it is charged by said charging means but it not undergoing image transfer, and measures the surface potential of said image carrier when it is charged by said charging means and is undergoing image transfer.

47. An image forming apparatus as claimed in claim 43, further comprising fixing means for fixing toner images upon said transfer material, wherein toner images of different colors are formed upon said transfer material, one superimposed upon the other, by said transfer means, said fixing means mixing the toners of different colors with each other in the process of fixing the image upon said transfer material.

48. An image forming apparatus as claimed in claim 43, further comprising a plurality of image forming sections each of which includes at least said image carrying member, said charging means, said measuring means, said developing means and said transfer means, image of different colors being formed in said image forming sections by superimposing one image upon the other on said transfer material.

49. An image forming apparatus as claimed in claim 43, wherein the number of said image forming sections is four, in correspondence with the colors: Yellow, magenta, cyan and black.

50. An image forming apparatus as claimed in claim 43, wherein said transfer means is comprised of transfer chargers the transfer current of which is controlled on the basis of the measuring result obtained by said measuring means.

51. An image forming apparatus comprising:

a movable image carrying member;

charging means for charging said image carrying member;

measuring means for measuring the surface potential of said image carrying member; and transfer means for transferring images formed on said image carrying member to a transfer material;

wherein said measuring means measures the surface potential of said image carrying member in a first image forming process for transferring images to said transfer material, and wherein said transfer means is controlled for a second, subsequent image forming process on the basis of the measuring result.

52. An image forming apparatus as claimed in claim 51, wherein said transfer means includes means for forming a transfer electric field adapted to transfer the images to the transfer material, the transfer electric field being controlled on the basis of the measurement result obtained by said measuring means.

53. An image forming apparatus as claimed in claim 52, wherein said transfer electric field is controlled so that the change in surface-potential value of the image carrying member before and after image transfer is substantially constant.

54. An image forming apparatus as claimed in claim 51, wherein said measuring means measures the surface potential of said image carrying member when it is charged by said charging means but is not undergoing image transfer, and measures the surface potential of said image carrying member when it is charged by said charging means and is undergoing image transfer.

55. An image forming apparatus as claimed in claim 54, wherein even in the image forming process, those sections of said image carrying member where its surface potential is measured undergo only charging and image transfer which are effected by said charging means and said transfer means, respectively.

56. An image forming apparatus as claimed in claim 51, further comprising fixing means for fixing toner images upon said transfer material, wherein toner images of different colors are formed upon said transfer material, one superimposed upon the other, by said transfer means, said fixing means mixing the toners of different colors with each other in the process of fixing the images upon said transfer material.

57. An image forming apparatus as claimed in claim 51, further comprising a plurality of image forming sections each of which includes at least said image carrying member, said charging means, said measuring means, said developing means and said transfer means, images of different colors being formed in said image forming sections by superimposing one image upon the other on said transfer material.

58. An image forming apparatus as claimed in claim 57, wherein the number of said image forming sections is four, in correspondence with the colors: yellow, magenta, cyan and black.

59. An image forming apparatus as claimed in claim 51, further comprising a transfer drum adapted to adsorb said transfer material, images being formed upon said transfer material, with one superimposed upon the other, by rotating said transfer drum.

60. An image forming apparatus as claimed in claim 51, wherein said transfer means is comprised of transfer chargers, whose transfer current is controlled on the basis of the measuring result obtained by said measuring means.

* * * * *

UNITED STATES PATENT AND TRADEMARK OFFICE

CERTIFICATE OF CORRECTION

PATENT NO. : 5,041,877

DATED : August 20, 1991

INVENTOR(S) : Kenichi Matsumoto

It is certified that error appears in the above-identified patent and that said Letters Patent is hereby corrected as shown below:

On the title page: Item

[56] REFERENCES CITED:

FOREIGN PATENT DOCUMENTS, "99675 10/1982 Japan and 57364 8/1985 Japan" should read --99675 6/1982 Japan and 57364 4/1985 Japan--.

COLUMN 10:

Line 27, "transfer charges" should read --transfer chargers--.

COLUMN 12:

Line 37, "means the" should read --means measures the--.

COLUMN 13:

Line 1, "claim" (first occurrence) should read --claimed--.

Line 3, "Yellow," should read --yellow,--.

Line 5, "claim" (first occurrence) should read --claimed--.

Line 60, "Yellow," should read --yellow,--.

COLUMN 14:

Line 12, "absorb" should read --adsorb--.

UNITED STATES PATENT AND TRADEMARK OFFICE

CERTIFICATE OF CORRECTION

PATENT NO. : 5,041,877 Page 2 of 2

DATED : August 20, 1991

INVENTOR(S) : Kenichi Matsumoto

It is certified that error appears in the above-identified patent and that said Letters Patent is hereby corrected as shown below:

Line 32, "it" should read --is--.

Line 49, "image" (first occurrence) should read --images--.

Line 54, "Yellow," should read --yellow,--.

Signed and Sealed this

Twentieth Day of April, 1993

*Attest:*

MICHAEL K. KIRK

*Attesting Officer*

*Acting Commissioner of Patents and Trademarks*